US011804162B2

(12) United States Patent
Byun

(10) Patent No.: US 11,804,162 B2
(45) Date of Patent: Oct. 31, 2023

(54) DISPLAY DEVICE INCLUDING FOUR COLOR SUBPIXELS AND METHOD OF DRIVING THE SAME

(71) Applicant: LG DISPLAY CO., LTD., Seoul (KR)

(72) Inventor: Min-Chul Byun, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 42 days.

(21) Appl. No.: 17/476,034

(22) Filed: Sep. 15, 2021

(65) Prior Publication Data

US 2022/0139287 A1 May 5, 2022

(30) Foreign Application Priority Data

Oct. 30, 2020 (KR) ..... 10-2020-0143596

(51) Int. Cl.
*G09G 3/20* (2006.01)

(52) U.S. Cl.
CPC ... *G09G 3/2003* (2013.01); *G09G 2300/0452* (2013.01); *G09G 2310/027* (2013.01); *G09G 2310/08* (2013.01); *G09G 2320/043* (2013.01); *G09G 2360/16* (2013.01)

(58) Field of Classification Search
None
See application file for complete search history.

(56) References Cited

U.S. PATENT DOCUMENTS 8,531,367 B2 * 9/2013 Son ..... G09G 3/3648 345/88
9,666,115 B2 * 5/2017 Zhang ..... H04N 9/646
2008/0084524 A1 * 4/2008 Inuzuka ..... G09G 3/3413 349/108
2008/0101692 A1 * 5/2008 Tanase ..... H04N 1/6022 382/162
2009/0046307 A1 * 2/2009 Kwak ..... G09G 5/02 358/1.9
2009/0102769 A1 * 4/2009 Kouno ..... G09G 3/3648 345/88
2010/0091030 A1 * 4/2010 Park ..... G09G 3/2003 345/55
2011/0084990 A1 * 4/2011 An ..... G09G 3/3648 345/690
2012/0306947 A1 * 12/2012 Kim ..... G09G 3/3233 345/694
2013/0070007 A1 * 3/2013 Park ..... G09G 3/3233 345/694

(Continued)

*Primary Examiner* — Patrick N Edouard
*Assistant Examiner* — Peijie Shen
(74) *Attorney, Agent, or Firm* — Morgan, Lewis & Bockius LLP

(57) ABSTRACT

A display device includes: a timing controlling part generating a three color image data, a data control signal and a gate control signal using an image signal and a plurality of timing signals, generating a first four color data having a white gray level data greater than 0 and a second four color data having the white gray level data of 0 using the three color image data, and generating a four color image data using the first and second four color data; a data driving part generating a data signal using the four color data and the data control signal; a gate driving part generating a gate signal using the gate control signal; and a display panel including a pixel having red, green, blue and white subpixels and displaying an image using the data signal and the gate signal.

14 Claims, 13 Drawing Sheets

(56) References Cited

U.S. PATENT DOCUMENTS

| | | | | |
|---|---|---|---|---|
| 2014/0184655 | A1* | 7/2014 | Jang | G09G 3/2003 345/83 |
| 2015/0262530 | A1* | 9/2015 | Sato | G09G 3/3233 345/83 |
| 2015/0364081 | A1* | 12/2015 | Tseng | G09G 3/3413 345/694 |
| 2016/0019851 | A1* | 1/2016 | Chen | G09G 3/3607 345/89 |
| 2016/0140924 | A1* | 5/2016 | Heo | G09G 3/2003 345/88 |
| 2016/0225323 | A1* | 8/2016 | Lu | G09G 3/3406 |
| 2016/0267685 | A1* | 9/2016 | Yang | G09G 3/2003 |
| 2018/0082658 | A1* | 3/2018 | Atkins | G09G 5/02 |
| 2018/0211577 | A1* | 7/2018 | Pan | G09G 3/3208 |
| 2020/0058265 | A1* | 2/2020 | He | G09G 5/10 |
| 2022/0122556 | A1* | 4/2022 | Meng | G09G 3/2003 |

* cited by examiner

FIG. 7

| luminance ratio(α) | lifetime improvement rate | |
|---|---|---|
| | before adjusting area ratio | after adjusting area ratio |
| 0 | 100% | 100% |
| 0.1 | 119% | 103% |
| 0.2 | 144% | 106% |
| 0.3 | 178% | 109% |
| 0.4 | 228% | 113% |
| 0.5 | 304% | 117% |

FIG. 12

| time ratio(β) | lifetime improvement rate | |
|---|---|---|
| | before adjusting area ratio | after adjusting area ratio |
| 0 | 100% | 100% |
| 0.1 | 111% | 102% |
| 0.2 | 124% | 104% |
| 0.3 | 141% | 106% |
| 0.4 | 164% | 108% |
| 0.5 | 195% | 111% |

DISPLAY DEVICE INCLUDING FOUR COLOR SUBPIXELS AND METHOD OF DRIVING THE SAME

CROSS-REFERENCE TO RELATED APPLICATION

The present application claims the priority benefit of Korean Patent Application No. 10-2020-0143596 filed on Oct. 30, 2020, which is hereby incorporated by reference in its entirety.

BACKGROUND

Technical Field

The present disclosure relates to a display device, and more particularly, to a display device displaying a white using red, green, blue and white subpixels and a method of driving the display device.

Discussion of the Related Art

As an information-oriented society progresses, demand for a display device displaying an image have increased with various forms. In a display device field, a cathode ray tube (CRT) having a relatively large volume has been rapidly replaced by a flat panel display (FPD) device having a thin profile, a light weight and applicable to a relatively large size. The FPD device includes a liquid crystal display (LCD) device, a plasma display panel (PDP), an organic light emitting display (OLED) device and a field emission display (FED) device.

The display device displays an image using a plurality of pixels, and each pixel includes red, green and blue subpixels. Recently, to improve visibility under a bright circumstance such as the outdoors by increasing a luminance of the image, a display device where each pixel includes red, green, blue and white subpixels has been suggested.

In the display device including four color subpixels, to optimize a color coordinate and a color temperature and to increase a light efficiency, an achromatic color such as a white is displayed by driving the green, blue and white subpixels (on) without driving the red subpixel (off).

However, in an area such as a logo where a white is steadily displayed for a relatively long time period, the white subpixel is intensively deteriorated to generate a residual image and a lifetime of the white subpixel and the display device is reduced.

SUMMARY

Accordingly, embodiments of the present disclosure are directed to a display device that substantially obviates one or more of the problems due to limitations and disadvantages of the related art.

An aspect of the present disclosure is to provide a display device where deterioration of a white subpixel is minimized, a residual image is prevented, and a lifetime is improved by displaying a white of a residual image area with a four color image data of a sum of a first four color data including a gray level data corresponding to a white and a second four color data not including a gray level data corresponding to a white and a method of driving the display device.

Another aspect of the present disclosure is to provide a display device where deterioration of a white subpixel is minimized, a residual image is prevented, and a lifetime is improved by displaying a white of a residual image area with alternation of a first four color data including a gray level data corresponding to a white and a second four color data not including a gray level data corresponding to a white and a method of driving the display device.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, a display device includes: a timing controlling part generating a three color image data, a data control signal and a gate control signal using an image signal and a plurality of timing signals, generating a first four color data having a white gray level data greater than 0 and a second four color data having the white gray level data of 0 using the three color image data, and generating a four color image data using the first and second four color data; a data driving part generating a data signal using the four color data and the data control signal; a gate driving part generating a gate signal using the gate control signal; and a display panel including a pixel having red, green, blue and white subpixels and displaying an image using the data signal and the gate signal.

In another aspect, a method of driving a display device includes: generating a three color image data, a data control signal and a gate control signal using an image signal and a plurality of timing signals, generating a first four color data having a white gray level data greater than 0 and a second four color data having the white gray level data of 0 using the three color image data, and generating a four color image data using the first and second four color data; generating a data signal using the four color data and the data control signal; generating a gate signal using the gate control signal; and displaying an image using the data signal and the gate signal in a display panel including a pixel having red, green, blue and white subpixels.

It is to be understood that both the foregoing general description and the following detailed description are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate aspects of the disclosure and together with the description serve to explain principles of the disclosure. In the drawings:

FIG. 7 is a view showing a lifetime improvement rate of a display device according to a first embodiment of the present disclosure;

FIG. 12 is a view showing a lifetime improvement rate of a display device according to a second embodiment of the present disclosure.

DETAILED DESCRIPTION

Figure 1:
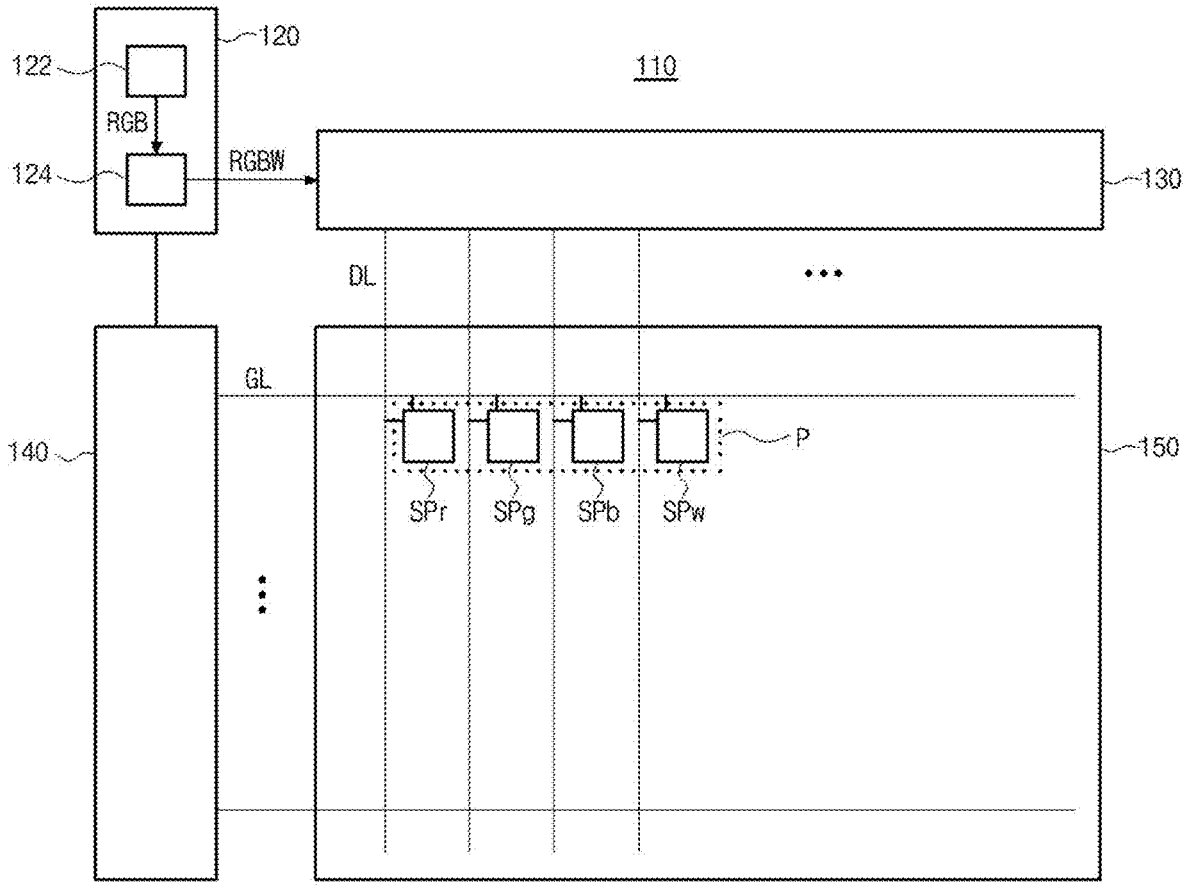
FIG. 1 is a view showing a display device according to a first embodiment of the present disclosure.

Reference will now be made in detail to aspects of the present disclosure, examples of which may be illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations are selected only for convenience of writing the specification and may be thus different from those used in actual products.

Advantages and features of the present disclosure, and implementation methods thereof will be clarified through following example aspects described with reference to the accompanying drawings. The present disclosure may, however, be embodied in different forms and should not be construed as limited to the example aspects set forth herein. Rather, these example aspects are provided so that this disclosure may be sufficiently thorough and complete to assist those skilled in the art to fully understand the scope of the present disclosure. Further, the present disclosure is only defined by scopes of claims.

A shape, a size, a ratio, an angle, and a number disclosed in the drawings for describing aspects of the present disclosure are merely an example. Thus, the present disclosure is not limited to the illustrated details. Like reference numerals refer to like elements throughout. In the following description, when the detailed description of the relevant known function or configuration is determined to unnecessarily obscure an important point of the present disclosure, the detailed description of such known function or configuration may be omitted. In a case where terms "comprise," "have," and "include" described in the present specification are used, another part may be added unless a more limiting term, such as "only," is used. The terms of a singular form may include plural forms unless referred to the contrary.

In construing an element, the element is construed as including an error or tolerance range even where no explicit description of such an error or tolerance range. In describing a position relationship, when a position relation between two parts is described as, for example, "on," "over," "under," or "next," one or more other parts may be disposed between the two parts unless a more limiting term, such as "just" or "direct(ly)," is used.

In describing a time relationship, when the temporal order is described as, for example, "after," "subsequent," "next," or "before," a case which is not continuous may be included unless a more limiting term, such as "just," "immediate(ly)," or "direct(ly)," is used.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

In describing elements of the present disclosure, the terms like "first," "second," "A," "B," "(a)," and "(b)" may be used. These terms are merely for differentiating one element from another element, and the essence, sequence, order, or number of a corresponding element should not be limited by the terms. Also, when an element or layer is described as being "connected," "coupled," or "adhered" to another element or layer, the element or layer can not only be directly connected or adhered to that other element or layer, but also be indirectly connected or adhered to the other element or layer with one or more intervening elements or layers "disposed" between the elements or layers, unless otherwise specified.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

In the description of aspects, when a structure is described as being positioned "on or above" or "under or below" another structure, this description should be construed as including a case in which the structures contact each other as well as a case in which a third structure is disposed therebetween. The size and thickness of each element shown in the drawings are given merely for the convenience of description, and aspects of the present disclosure are not limited thereto.

Features of various aspects of the present disclosure may be partially or overall coupled to or combined with each other, and may be variously inter-operated with each other and driven technically as those skilled in the art can sufficiently understand. Aspects of the present disclosure may be carried out independently from each other, or may be carried out together in co-dependent relationship.

Reference will now be made in detail to the present disclosure, examples of which are illustrated in the accompanying drawings.

FIG. 1 is a view showing a display device according to a first embodiment of the present disclosure. The display device may include an organic light emitting diode (OLED) display device.

In FIG. 1, a display device 110 according to a first embodiment of the present disclosure includes a timing controlling part 120, a data driving part 130, a gate driving part 140 and a display panel 150.

The timing controlling part 120 generates a four color image data RGBW, a data control signal and a gate control signal using an image signal and a plurality of timing signals of a data enable signal, a horizontal synchronization signal, a vertical synchronization signal and a clock transmitted from an external system (not shown) such as a graphic card or a television system. The timing controlling part 120 transmits the four color image data RGBW and the data control signal to the data driving part 130 and transmits the gate control signal to the gate driving part 140.

The data driving part 130 generates a data voltage (data signal) using the data control signal and the four color image data RGBW transmitted from the timing controlling part 120 and transmits the data voltage to a data line DL of the display panel 150.

The gate driving part 140 generates a gate voltage (gate signal) using the gate control signal transmitted from the timing controlling part 120 and transmits the gate voltage to a gate line GL of the display panel 150.

The gate driving part 140 may have a gate-in-panel (GIP) type where the gate driving part 140 is disposed on a substrate of the display panel 150 having the gate line GL, the data line DL and a pixel P.

The display panel 150 displays an image using the gate voltage and the data voltage and includes a plurality of pixels P, a plurality of gate lines GL and a plurality of data lines DL.

Each of the plurality of pixels P includes red, green, blue and white subpixels SPr, SPg, SPb and SPw. The gate line GL and the data line DL cross each other to define the red, green, blue and white subpixels SPr, SPg, SPb and SPw, and each of the red, green, blue and white subpixels SPr, SPg, SPb and SPw is connected to the gate line GL and the data line DL.

When the display device 110 is an OLED display device, each of the red, green, blue and white subpixels SPr, SPg, SPb and SPw may include a plurality of thin film transistors (TFTs) such as a switching TFT, a driving TFT and a sensing TFT, a storage capacitor and a light emitting diode.

In the display device 110, the timing controlling part 120 generates a three color image data RGB using the image signal transmitted from the external system and generates the four color image data RGBW using the three color image data RGB. The timing controlling part 120 transmits the four color image data RGBW to the data driving part 130.

The timing controlling part 120 includes a three color image data generating part 122 generating the three color image data RGB using the image signal and the plurality of timing signals and a four color image data generating part 124 generating the four color image data RGBW using the three color image data RGB.

For example, the three color image data generating part 122 may generate the three color image data RGB including red, green and blue gray level data corresponding to luminances of red, green and blue colors, respectively, and may transmit the three color image data RGB to the four color image data generating part 124. The four color image data generating part 124 may generate the four color image data RGBW including red, green, blue and white gray level data corresponding to luminances of red, green, blue and white colors, respectively, and may transmit the four color image data RGBW to the data driving part 130.

In the display device 110 according to a first embodiment of the present disclosure, the timing controlling part 120 supplies the four color image data RGBW calculated by adding a first four color data RGBW1 (of FIGS. 2 and 4) including a white gray level data and a second four color data RGBW2 (of FIGS. 2 and 4) not including a white gray level data to a residual image area RA (of FIGS. 2 and 3) where a white is steadily displayed for a relatively ling time period and the white subpixel SPw is intensively deteriorated. As a result, a residual image is prevented and a lifetime is improved.

Figure 2:
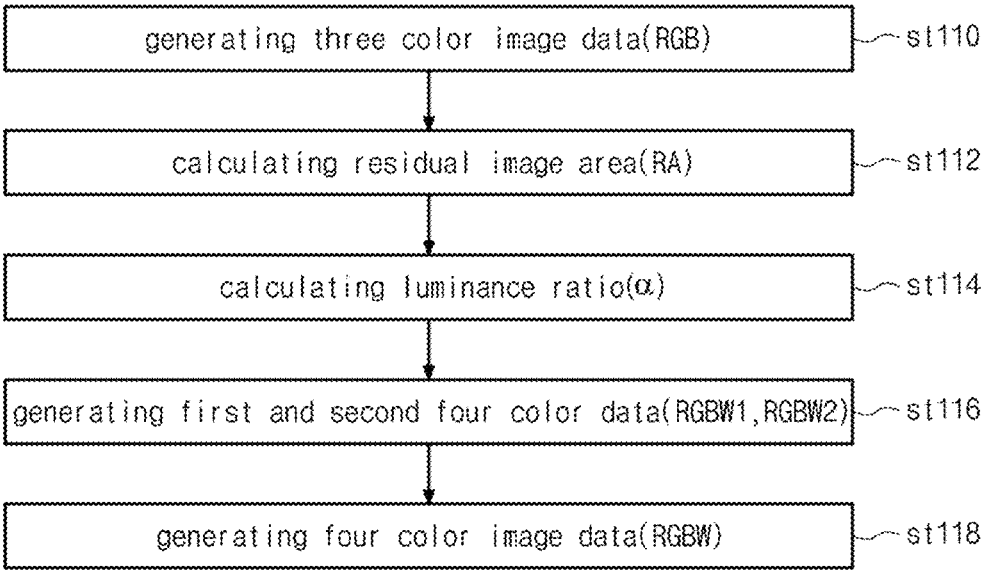
FIG. 2 is a flow chart showing a method of driving a display device according to a first embodiment of the present disclosure.

FIG. 2 is a flow chart showing a method of driving a display device according to a first embodiment of the present disclosure.

In FIG. 2, the three color image data generating part 122 (of FIG. 1) of the timing controlling part 120 (of FIG. 1) of the display device 110 (of FIG. 1) according to a first embodiment of the present disclosure generates a three color image data RGB including red, green and blue gray level data corresponding to luminances of red, green and blue colors, respectively, using the image signal and the plurality of timing signals. (st110)

Next, the four color image data generating part 124 (of FIG. 1) of the timing controlling part 120 calculates the residual image area RA where a white is steadily displayed for a relatively long time period and the light emitting diode of the white subpixel SPw (of FIG. 1) is deteriorated. (st112)

For example, the four color image data generating part 124 may calculate the residual image area RA using a histogram of a cumulative luminance average.

Figure 3:
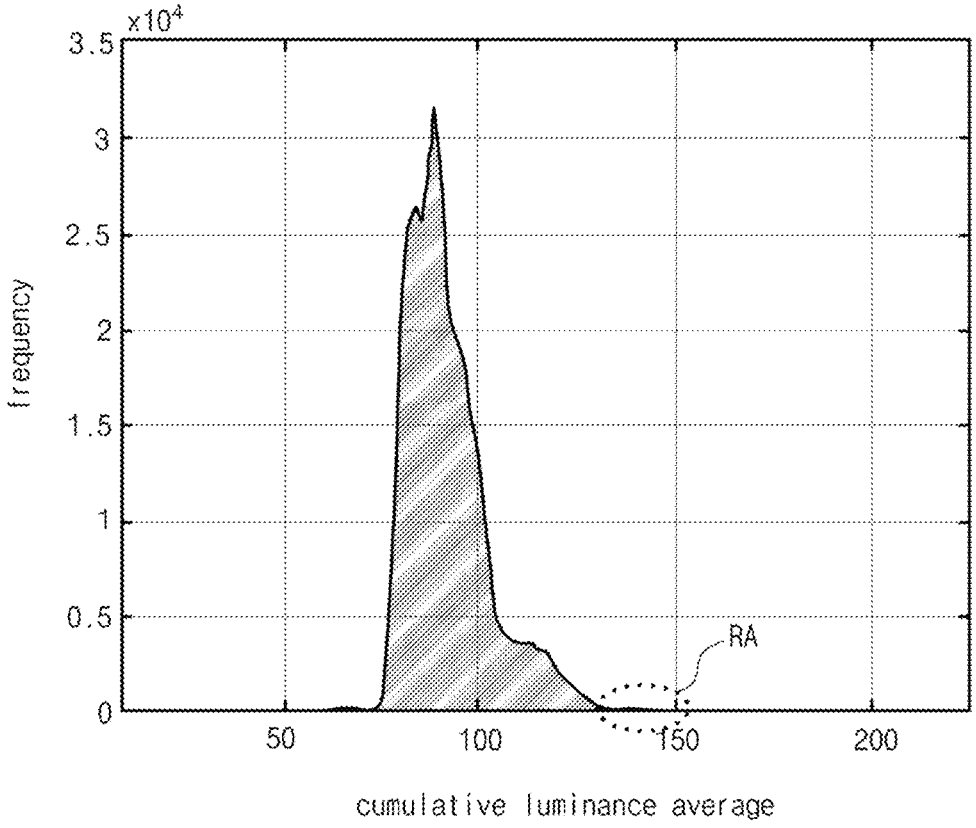
FIG. 3 is a view showing a histogram used for calculating a residual image area of a display device according to a first embodiment of the present disclosure.

FIG. 3 is a view showing a histogram used for calculating a residual image area of a display device according to a first embodiment of the present disclosure.

In FIG. 3, the timing controlling part 120 (of FIG. 1) of the display device 110 (of FIG. 1) calculates a cumulative luminance by adding luminances displayed by the plurality of pixels P (of FIG. 1). In addition, the timing controlling part 120 calculates a cumulative luminance average by dividing the cumulative luminance by a time or a frame and calculates a histogram according to a frequency where the corresponding cumulative luminance average occurs among the plurality of pixels P (of FIG. 1).

Here, since the residual image area RA where a white is steadily displayed for a relatively long time period has a relatively high cumulative luminance average, a region adjacent to an upper limit of the cumulative luminance average of the histogram may be calculated as the residual image area RA.

For example, the timing controlling part 120 may calculate a top 1% (a range of about 99% to about 100%) of the cumulative luminance average, preferably a top 0.1% (a range of about 99.9% to about 100%) of the cumulative luminance average as the residual image area RA.

Although the four color image data generating part 124 (of FIG. 1) of the timing controlling part 120 calculates the residual image area RA in the first embodiment, the three color image data generating part 122 (of FIG. 1) of the timing controlling part 120 may generate the residual image area RA and may transmit the residual image area RA to the four color image data generating part 124 in another embodiment.

Referring again to FIG. 2, after the residual image area RA is calculated, the four color image data generating part 124 of the timing controlling part 120 calculates a luminance ratio $\alpha$ of a ratio of a luminance corresponding to the second four color data RGBW2 to a luminance corresponding to the four color image data RGBW. (st114)

The luminance ratio α is a factor determining a ratio of luminances corresponding to the first and second four color data RGBW1 and RGBW2. The luminance of the first four color data RGBW1 may be proportional to a value (1−α) obtained by subtracting the luminance ratio α from 1 to contribute to the luminance of the four color image data RGBW, and the luminance of the second four color data RGBW2 may be proportional to the luminance ratio α to contribute to the luminance of the four color image data RGBW.

The luminance ratio α may be updated by comparing deterioration of the red, green and blue subpixels SPr, SPg and SPb in the residual image area RA and the other area.

Next, the four color image data generating part 124 of the timing controlling part 120 generates the first and second four color data RGBW1 and RGBW2 using the three color image data RGB of the residual image area RA. (st116)

Each of the first and second four color data RGBW1 and RGBW2 includes red, green, blue and white gray level data. The gray level data of the first four color data RGBW1 corresponding to a luminance of one of red, green and blue colors is 0, and the gray level data of the second four color data RGBW2 corresponding to a luminance of a white color is 0.

For example, the first four color data RGBW1 may include the red gray level data of 0 and the green, blue and white gray data different from 0 (greater than 0), and the second four color data RGBW2 may include the white gray level of 0 and the red, green and blue gray data different from 0 (greater than 0).

Next, the four color image data generating part 124 of the timing controlling part 120 generates the four color image data RGBW using the first and second four color data RGBW1 and RGBW2 and the luminance ratio α. (st118)

For example, the four color image data generating part 124 may generate the four color image data RGBW such that a sum of a first value obtained by multiplying a value (1−α) obtained by subtracting the luminance ratio α from 1 and the luminance Y(RGBW1) of the first four color data RGBW1 and a second value obtained by multiplying the luminance value α and the luminance Y(RGBW2) of the second four color data RGBW2 becomes the luminance Y(RGBW) of the four color image data RGBW. ((1−α)*Y(RGBW1)+α*Y(RGBW2)=Y(RGBW))

Figure 4:
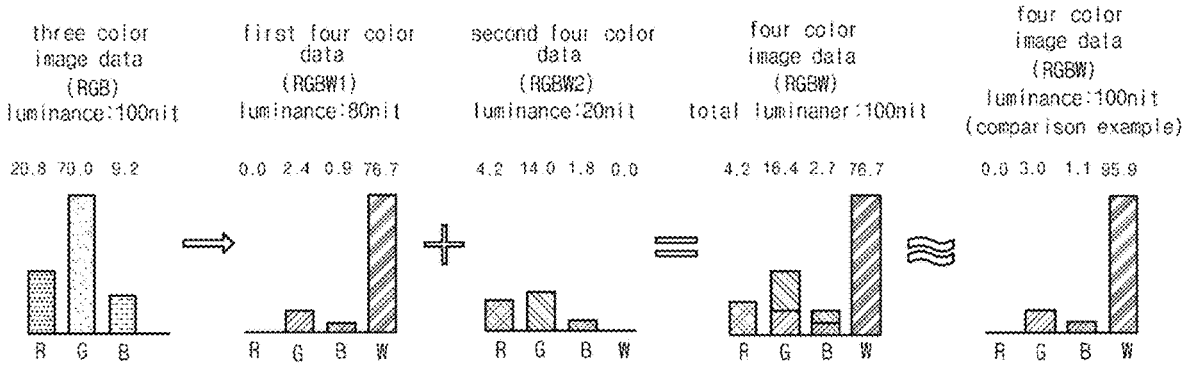
FIG. 4 is a view showing a three color image data and a four color image data of a display device according to a first embodiment of the present disclosure.

FIG. 4 is a view showing a three color image data and a four color image data of a display device according to a first embodiment of the present disclosure.

In FIG. 4, the three color image data generating part 122 (of FIG. 1) of the timing controlling part 120 (of FIG. 1) of the display device 110 (of FIG. 1) according to a first embodiment of the present disclosure generates the three color image data RGB of a luminance of about 100 nit corresponding to a white of the residual image area RA. The red, green and blue gray level data of the three color image data RGB may correspond to luminances of about 20.8 nit, about 70.0 nit and about 9.2 nit, respectively.

The four color image data generating part 122 calculates the luminance ratio α of about 0.2 and calculates a first contributing component corresponding to a luminance of about 80 nit by multiplying the first four color data RGBW1 having the red gray level data of 0 and a value (1−α) of about 0.8 obtained by subtracting the luminance ratio α from 1. The red, green, blue and white gray level data of the first contributing component of the first four color data RGBW1 may correspond to the luminances of about 0.0 nit, about 2.4 nit, about 0.9 nit and about 76.7 nit, respectively.

The four color image data generating part 122 calculates a second contributing component corresponding to a luminance of about 20 nit by multiplying the red, green, blue and white gray level data of the second four color data RGBW2 having the white gray level data of 0 and the luminance ratio α. The red, green, blue and white gray level data of the second contributing component of the second four color data RGBW2 may correspond to the luminances of about 4.2 nit, about 14.0 nit, about 1.8 nit and about 0.0 nit, respectively.

The four color image data generating part 122 calculates the four color image data RGBW corresponding to a luminance of about 100 nit by adding the first contributing component of the first four color data RGBW1 and the second contributing component of the second four color data RGBW2. The red, green, blue and white gray level data of the four color image data RGBW may correspond to the luminances of about 4.2 nit, about 16.4 nit, about 2.7 nit and about 76.7 nit, respectively.

The red, green, blue and white gray level data of the four color image data RGBW having the red gray level data of 0 and corresponding to the luminance of about 100 nit according to a comparison example may correspond to the luminances of about 0.0 nit, about 3.0 nit, about 1.1 nit and about 95.9 nit, respectively.

Although the four color image data RGBW having the red, green, blue and white gray level data different from 0 (greater than 0) of a first embodiment of the present disclosure corresponds the luminance of about 100 nit the same as the four color image data RGBW having three color image data RGB and the red gray level data of 0, the white gray level data of the four color image data RGBW of the first embodiment decreases and the red, green and blue gray level data of the four color image data RGBW of the first embodiment increase as compared with the four color image data RGBW of the comparison example. As a result, deterioration of the white subpixel SPw is minimized.

Figure 5:
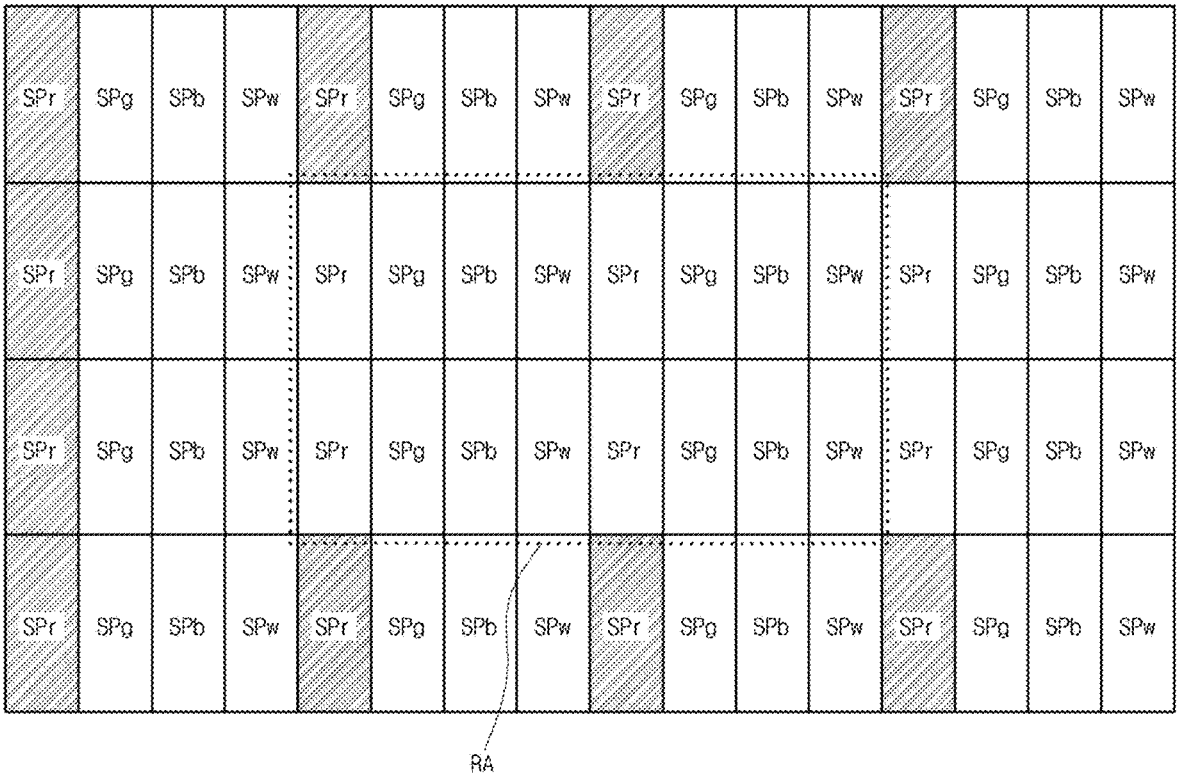
FIG. 5 is a view showing an emission state of a residual image area of a display device according to a first embodiment of the present disclosure.

FIG. 5 is a view showing an emission state of a residual image area of a display device according to a first embodiment of the present disclosure.

In FIG. 5, when the display device 110 (of FIG. 1) according to a first embodiment of the present disclosure displays a white, the four color image data RGBW having the red, green, blue and white gray level data different from 0 (greater than 0) is displayed in the residual image area RA, and the four color image data RGBW (comparison example of FIG. 4) having the red gray level data of 0 is displayed in an adjacent area other than the residual image area RA.

All of the red, green, blue and white subpixels SPr, SPg, SPb and SPw of the residual image area RA emit a light, and the red subpixel SPr of the adjacent area does not emit a light and the green, blue and white subpixels SPg, SPb and SPw of the adjacent area emit a light. As a result, in the residual image area RA, a stress concentrated on the white subpixel SPw is dispersed to the red, green and blue subpixels SPr, SPg and SPb and deterioration of the white subpixel SPw is minimized.

Figure 6:
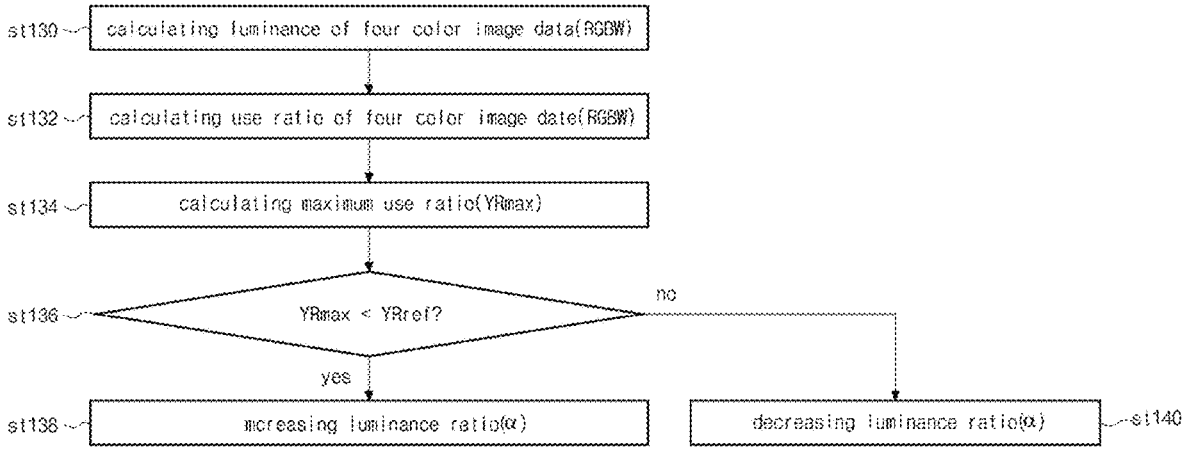
FIG. 6 is a flow chart showing a method of updating a luminance ratio of a display device according to a first embodiment of the present disclosure.

FIG. 6 is a flow chart showing a method of updating a luminance ratio of a display device according to a first embodiment of the present disclosure.

In FIG. 6, the timing controlling part 120 (of FIG. 1) of the display device 110 (of FIG. 1) according to a first embodiment of the present disclosure may update the luminance ratio α with a predetermined period.

The timing controlling part 120 calculates the cumulative luminance averages Yra(R), Yra(G) and Yra(B) of the red, green and blue gray level data of the four color image data RGBW corresponding to an achromatic color (white) of the residual image area RA according to an initial value of the luminance ratio α and calculates the cumulative luminance averages Yaa(R), Yaa(G) and Yaa(B) of the red, green and blue gray level data of the four color image data RGBW corresponding to a chromatic color of the adjacent area of the residual image area RA. (st130)

Next, the timing controlling part 120 calculates the red, green and blue use ratios YR(R), YR(G) and YR(B). (st132) The red, green and blue use ratios YR(R), YR(G) and YR(B) may be defined as a ratio of the cumulative luminance averages Yra(R), Yra(G) and Yra(B) of the four color image data RGBW of the residual image area RA to the cumulative luminance averages Yaa(R), Yaa(G) and Yaa(B) of the red, green and blue gray level data of the four color image data RGBW of the adjacent area. (YR(R)=Yra(R)/Yaa(R), YR(G)=Yra(G)/Yaa(G), YR(B)=Yra(B)/Yaa(B))

Next, the timing controlling part 120 calculates the maximum use ratio YRmax by selecting a maximum value from the red, green and blue use ratios YR(R), YR(G) and YR(B)(YRmax=MAX(YR(R), YR(G), YR(B)). (st134)

Next, the timing controlling part 120 compares the maximum use ratio YRmax with a predetermined reference use ratio YRref. (st136)

When the maximum use ratio YRmax is smaller than the reference use ratio YRref (YRmax<YRref), the luminance ratio α is updated such that an initial value of the luminance ratio α increases. (st138)

When the maximum use ratio YRmax is not smaller than (equal to or greater than) the reference use ratio YRref (YRmax≥YRref), the luminance ratio α is updated such that an initial value of the luminance ratio α decreases. (st140)

Although the initial value of the luminance ratio α is updated to decrease when the maximum use ratio YRmax is smaller than the reference use ratio YRref (YRmax<YRref) in the first embodiment, the initial value of the luminance ratio α may be maintained without change when the maximum use ratio YRmax is equal to the reference use ratio YRref (YRmax=YRref) in another embodiment.

For example, the timing controlling part 120 of the display device 110 according to a first embodiment of the present disclosure may update the luminance ratio α about every 600 hours.

When the initial value of the luminance ratio α is about 0.9 and the reference use ratio YRref is 0.5, after 600 hours from the beginning of driving the display device 110, the timing controlling part 120 may calculate the cumulative luminance averages Yra(R), Yra(G) and Yra(B) of the red, green and blue gray level data of the four color image data RGBW corresponding to the achromatic color (white) of the residual image area RA as about 52.5 nit, about 179.3 nit and about 22.3 nit, respectively, and may calculate the cumulative luminance averages Yaa(R), Yaa(G) and Yaa(B) of the red, green and blue gray level data of the four color image data RGBW corresponding to the chromatic color of the adjacent area as about 105 nit, about 350 nit and about 45 nit, respectively. (st130)

The timing controlling part 120 may calculate the red, green and blue use ratios YR(R), YR(G) and YR(B) as about 0.50(=52.5/105), about 0.51(=179.3/350) and about 0.50 (=22.3/45), respectively. (st132) The red, green and blue use ratios YR(R), YR(G) and YR(B) are defined as ratios of the cumulative luminance averages Yra(R), Yra(G) and Yra(B) of the red, green and blue gray level data of the four color image data RGBW corresponding to the achromatic color (white) of the residual image area RA to the cumulative luminance averages Yaa(R), Yaa(G) and Yaa(B) of the red, green and blue gray level data of the four color image data RGBW corresponding to the chromatic color of the adjacent area.

The timing controlling part 120 may calculate the maximum use ratio YRmax of about 0.51 by selecting a maximum value from the red use ratio YR(R) of about 0.50, the green use ratio of about 0.51 and the blue use ratio of about 0.50. (st134)

The timing controlling part 120 compares the maximum use ratio YRmax of about 0.51 with the reference use ratio YRref of 0.5. (st136) Since the maximum use ratio YRmax is greater than the reference use ratio YRref, the timing controlling part 120 may update the luminance ratio α by decreasing the initial value of the luminance ratio α of 0.9 to 0.5.

After 1200 hours from the beginning of driving the display device 110, when the present value of the luminance ratio α is about 0.5 and the reference use ratio YRref is 0.5, the timing controlling part 120 may calculate the cumulative luminance averages Yra(R), Yra(G) and Yra(B) of the red, green and blue gray level data of the four color image data RGBW corresponding to the achromatic color (white) of the residual image area RA as about 52.5 nit, about 179.9 nit and about 22.9 nit, respectively, and may calculate the cumulative luminance averages Yaa(R), Yaa(G) and Yaa(B) of the red, green and blue gray level data of the four color image data RGBW corresponding to the chromatic color of the adjacent area as about 105 nit, about 350 nit and about 45 nit, respectively. (st130)

The timing controlling part 120 may calculate the red, green and blue use ratios YR(R), YR(G) and YR(B) as about 0.50(=52.5/105), about 0.51(=179.9/350) and about 0.51 (=22.9/45), respectively. (st132) The red, green and blue use ratios YR(R), YR(G) and YR(B) are defined as ratios of the cumulative luminance averages Yra(R), Yra(G) and Yra(B) of the red, green and blue gray level data of the four color image data RGBW corresponding to the achromatic color (white) of the residual image area RA to the cumulative luminance averages Yaa(R), Yaa(G) and Yaa(B) of the red, green and blue gray level data of the four color image data RGBW corresponding to the chromatic color of the adjacent area.

The timing controlling part 120 may calculate the maximum use ratio YRmax of about 0.51 by selecting a maximum value from the red use ratio YR(R) of about 0.50, the green use ratio of about 0.51 and the blue use ratio of about 0.51. (st134)

The timing controlling part 120 compares the maximum use ratio YRmax of about 0.51 with the reference use ratio YRref of 0.5. (st136) Since the maximum use ratio YRmax is greater than the reference use ratio YRref, the timing controlling part 120 may update the luminance ratio α by decreasing the present value of the luminance ratio α of 0.5 to 0.0.

FIG. 7 is a view showing a lifetime improvement rate of a display device according to a first embodiment of the present disclosure.

In FIG. 7, as the luminance ratio α increases, the lifetime of a white light emitting layer of the white subpixel SPw (of FIG. 1) of the display device 110 (of FIG. 1) increases.

Before area ratios of the red, green, blue and white subpixels SPr, SPg, SPb and SPw to the pixel P (of FIG. 1) of the display device 110 are adjusted, the lifetime of the light emitting layer of the white subpixel SPw is 100% when the luminance ratio α is 0, and the lifetime of the light emitting layer of the white subpixel SPw is 304% when the luminance ratio α is 0.5. As a result, the lifetime of the light emitting layer of the white subpixel SPw for the luminance ratio α of 0.5 increases by about 204% as compared with the lifetime of the light emitting layer of the white subpixel SPw for the luminance ratio α of 0.

After area ratios of the red, green, blue and white subpixels SPr, SPg, SPb and SPw to the pixel P of the display device 110 are adjusted, the lifetime of the light emitting layer of the white subpixel SPw is 100% when the luminance ratio α is 0, and the lifetime of the light emitting layer of the white subpixel SPw is 117% when the luminance ratio α is 0.5. As a result, the lifetime of the light emitting layer of the white subpixel SPw for the luminance ratio α of 0.5 increases by about 17% as compared with the lifetime of the light emitting layer of the white subpixel SPw for the luminance ratio α of 0.

Accordingly, since the area ratios of the red, green, blue and white subpixels SPr, SPg, SPb and SPw to the pixel P of the display device 110 are adjusted according to the lifetime of the red, green, blue and white light emitting layers, a light efficiency and a lifetime are improved.

For example, the area of the light emitting layer having a relatively long lifetime may decrease and the driving current of the light emitting layer having a relatively long lifetime may increase. Further, the area of the light emitting layer having a relatively short lifetime may increase and the driving current of the light emitting layer having a relatively long lifetime may decrease.

In the display device 110 according to a first embodiment of the present disclosure, since the lifetime of the light emitting layer of the white subpixel SPw increases, the area ratio of the white subpixel SPw to the pixel P may decrease. As a result, although the lifetime improvement rate of the light emitting layer of the white subpixel SPw after adjusting the area ratio relatively decreases as compared with the lifetime improvement rate of the light emitting layer of the white subpixel SPw before adjusting the area ratio, the lifetime of the light emitting layer of the white subpixel SPw after adjusting the area ratio relatively increases as compared with the lifetime of the light emitting layer of the white subpixel SPw of the comparison example.

In the display device 110 according to a first embodiment of the present disclosure, since a white of the residual image area RA is displayed using the four color image data RGBW of a sum of the first four color data RGBW1 having the white gray data different from 0 (greater than 0) and the second four color data RGBW2 having the white gray data of 0, deterioration of the light emitting layer of the white subpixel SPw is minimized such that the residual image is prevented and the lifetime increases.

In another embodiment, the first four color data having the white gray data different from 0 (greater than 0) and the second four color data having the white gray data of 0 may be alternately driven.

Figure 8:
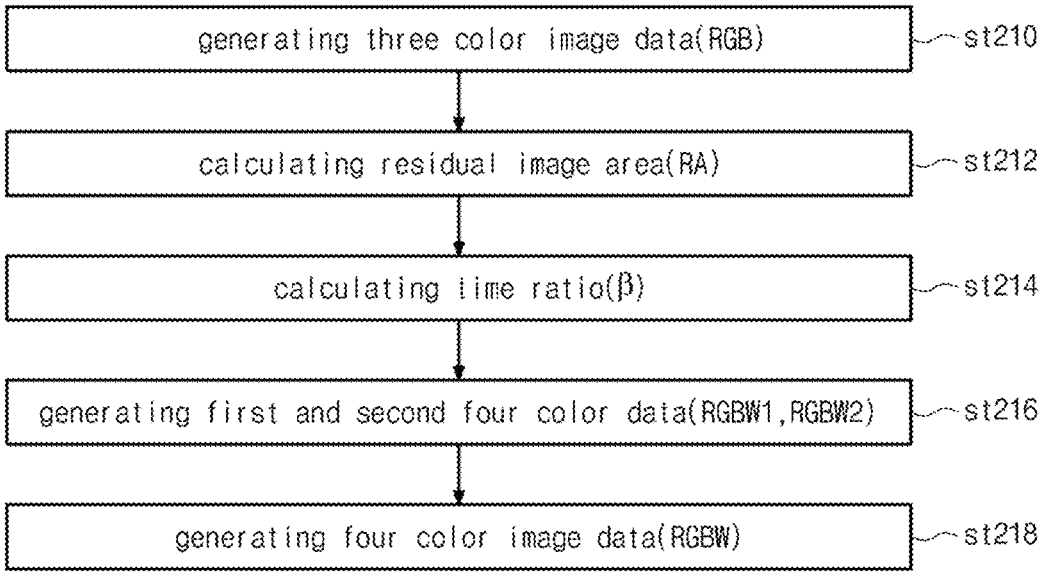
FIG. 8 is a flow chart showing a method of driving a display device according to a second embodiment of the present disclosure.

FIG. 8 is a flow chart showing a method of driving a display device according to a second embodiment of the present disclosure. A structure of a display device according to a second embodiment is the same as a structure of a display device according to a first embodiment.

In FIG. 8, the three color image data generating part 122 (of FIG. 1) of the timing controlling part 120 (of FIG. 1) of the display device 110 (of FIG. 1) according to a second embodiment of the present disclosure generates a three color image data RGB including red, green and blue gray level data corresponding to luminances of red, green and blue colors, respectively, using the image signal and the plurality of timing signals. (st210)

Next, the four color image data generating part 124 (of FIG. 1) of the timing controlling part 120 calculates the residual image area RA where a white is steadily displayed for a relatively long time period and the light emitting diode of the white subpixel SPw (of FIG. 1) is deteriorated. (st212)

For example, the four color image data generating part 124 may calculate the residual image area RA using a histogram of a cumulative luminance average.

Next, the four color image data generating part 124 of the timing controlling part 120 calculates a time ratio β of a ratio of a duration time where a luminance corresponding to the second four color data RGBW2 is displayed to a duration time where a luminance corresponding to the four color image data RGBW is displayed. (st214)

The time ratio β is a factor determining a ratio of duration times where luminances corresponding to the first and second four color data RGBW1 and RGBW2 are displayed. The luminance of the first four color data RGBW1 may be proportional to a value (1−β) obtained by subtracting the time ratio β from 1 to contribute to the luminance of the four color image data RGBW, and the luminance of the second four color data RGBW2 may be proportional to the time ratio β to contribute to the luminance of the four color image data RGBW.

The time ratio β may be determined by comparing deterioration of the red, green and blue subpixels SPr, SPg and SPb in the residual image area RA and the other area.

Next, the four color image data generating part 124 of the timing controlling part 120 generates the first and second four color data RGBW1 and RGBW2 using the three color image data RGB of the residual image area RA. (st216)

Each of the first and second four color data RGBW1 and RGBW2 includes red, green, blue and white gray level data. The gray level data of the first four color data RGBW1 corresponding to a luminance of one of red, green and blue colors is 0, and the gray level data of the second four color data RGBW2 corresponding to a luminance of a white color is 0.

For example, the first four color data RGBW1 may include the red gray level data of 0 and the green, blue and white gray data different from 0 (greater than 0), and the second four color data RGBW2 may include the white gray level of 0 and the red, green and blue gray data different from 0 (greater than 0).

Next, the four color image data generating part 124 of the timing controlling part 120 generates the four color image data RGBW using the first and second four color data RGBW1 and RGBW2 and the time ratio β. (st218)

For example, the four color image data generating part 124 may generate the first four color data RGBW1 as the four color image data RGBW for a first time period TP1 corresponding to a value (1−β) obtained by subtracting the time ratio β from 1 and may generate the second four color data RGBW2 as the four color image data RGBW for a second time period TP2 corresponding to the time ratio β. As a result, the first and second four color data RGBW1 and RGBW2 may be displayed alternately. (TP1:TP2=(1−β):β)

Figure 9:
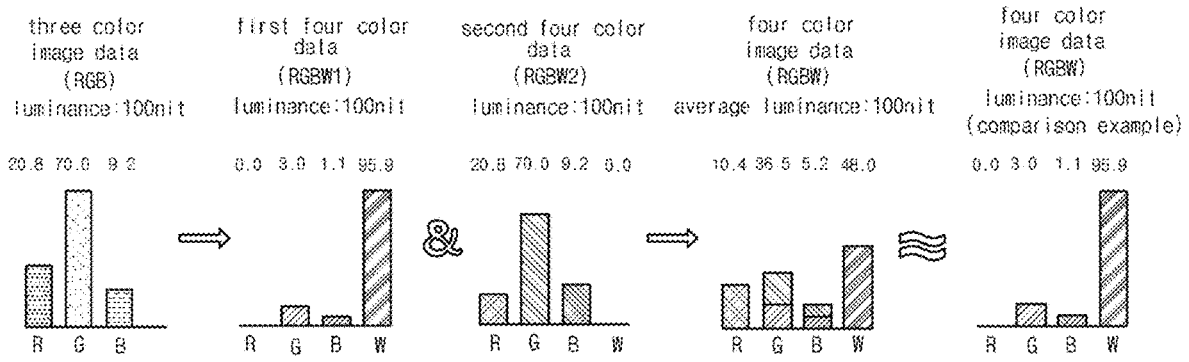
FIG. 9 is a view showing a three color image data and a four color image data of a display device according to a second embodiment of the present disclosure.

FIG. 9 is a view showing a three color image data and a four color image data of a display device according to a second embodiment of the present disclosure.

In FIG. 9, the three color image data generating part 122 (of FIG. 1) of the timing controlling part 120 (of FIG. 1) of the display device 110 (of FIG. 1) according to a second embodiment of the present disclosure generates the three color image data RGB of a luminance of about 100 nit corresponding to a white of the residual image area RA. The red, green and blue gray level data of the three color image data RGB may correspond to luminances of about 20.8 nit, about 70.0 nit and about 9.2 nit, respectively.

The four color image data generating part 122 calculates the time ratio β of about 0.5 and calculates the first four color data RGBW1 corresponding to a luminance of about 100 nit and having the red gray level data of 0 for the first time period TP1 corresponding to the value (1−β) obtained by subtracting the time ratio β from 1 as the four color image data RGBW. The red, green, blue and white gray level data of the first four color data RGBW1 may correspond to the luminances of about 0.0 nit, about 3.0 nit, about 1.1 nit and about 95.9 nit, respectively.

The four color image data generating part 122 calculates the second four color data RGBW2 corresponding to a luminance of about 100 nit and having the white gray level data of 0 for the second time period TP2 corresponding to the time ratio β as the four color image data RGBW. The red, green, blue and white gray level data of the second four color data RGBW2 may correspond to the luminances of about 20.8 nit, about 70.0 nit, about 9.2 nit and about 0.0 nit, respectively.

As a result, the four color image data generating part 122 displays a white of the residual image area RA with the four color image data RGBW corresponding to an average value of the first and second four color data RGBW1 and RGBW2 according to a time.

The four color image data generating part 122 calculates the four color image data RGBW corresponding to an average luminance of about 100 nit by adding a value obtained by multiplying the first four color data RGBW1 having the red gray data of 0 and the value (1−β) of about 0.5 of subtracting the time ratio β from 1 and a value obtained by multiplying the second four color data RGBW2 having the white gray data of 0 and the time ratio β of about 0.5. The red, green, blue and white gray level data of the four color image data RGBW may correspond to the luminances of about 10.4 nit, about 36.5 nit, about 5.2 nit and about 48.0 nit, respectively.

The red, green, blue and white gray level data of the four color image data RGBW having the red gray level data of 0 and corresponding to the luminance of about 100 nit according to a comparison example may correspond to the luminances of about 0.0 nit, about 3.0 nit, about 1.1 nit and about 95.9 nit, respectively.

Although the four color image data RGBW of an average value having the red, green, blue and white gray level data different from 0 (greater than 0) of a second embodiment of the present disclosure corresponds the luminance of about 100 nit the same as the four color image data RGBW having the red gray level data of 0, the white gray level data of the four color image data RGBW of the second embodiment decreases and the red, green and blue gray level data of the four color image data RGBW of the second embodiment increase as compared with the four color image data RGBW of the comparison example. As a result, deterioration of the white subpixel SPw is minimized.

Figure 10A:
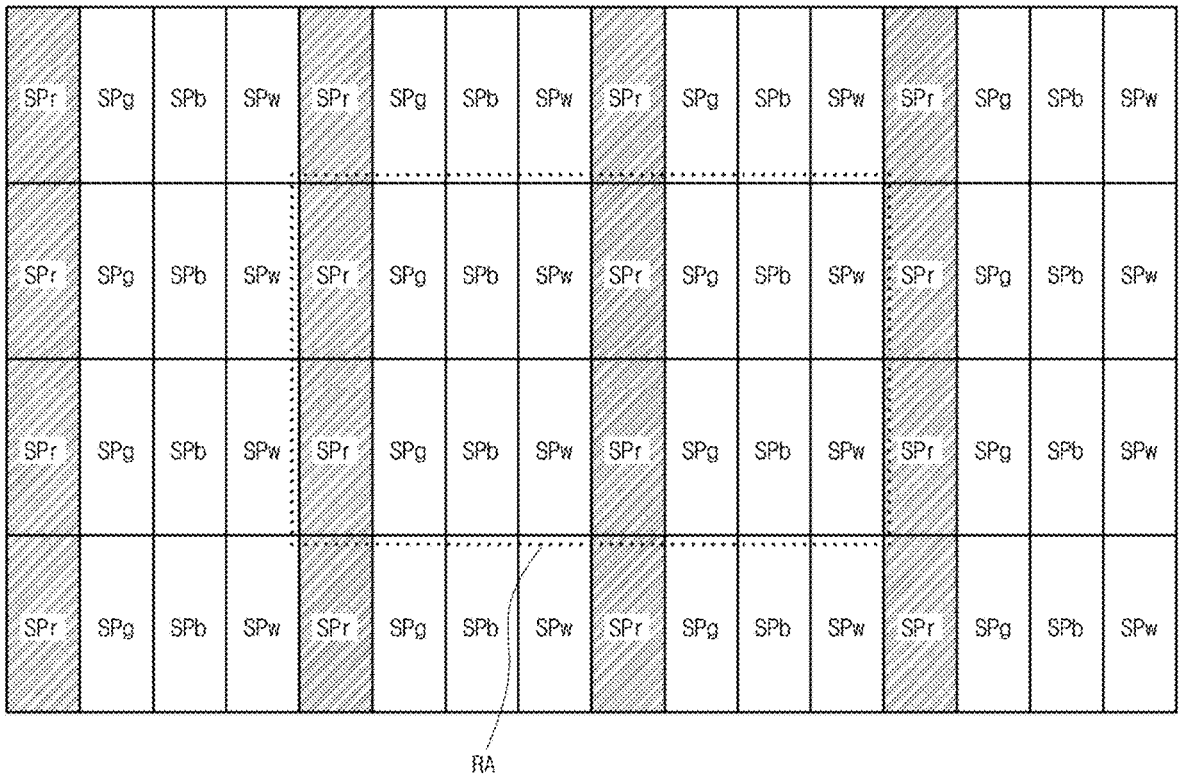
FIGS. 10A and 10B are views showing an emission state of a residual image area of a display device for first and second time periods, respectively, according to a second embodiment of the present disclosure.
Figure 10B:
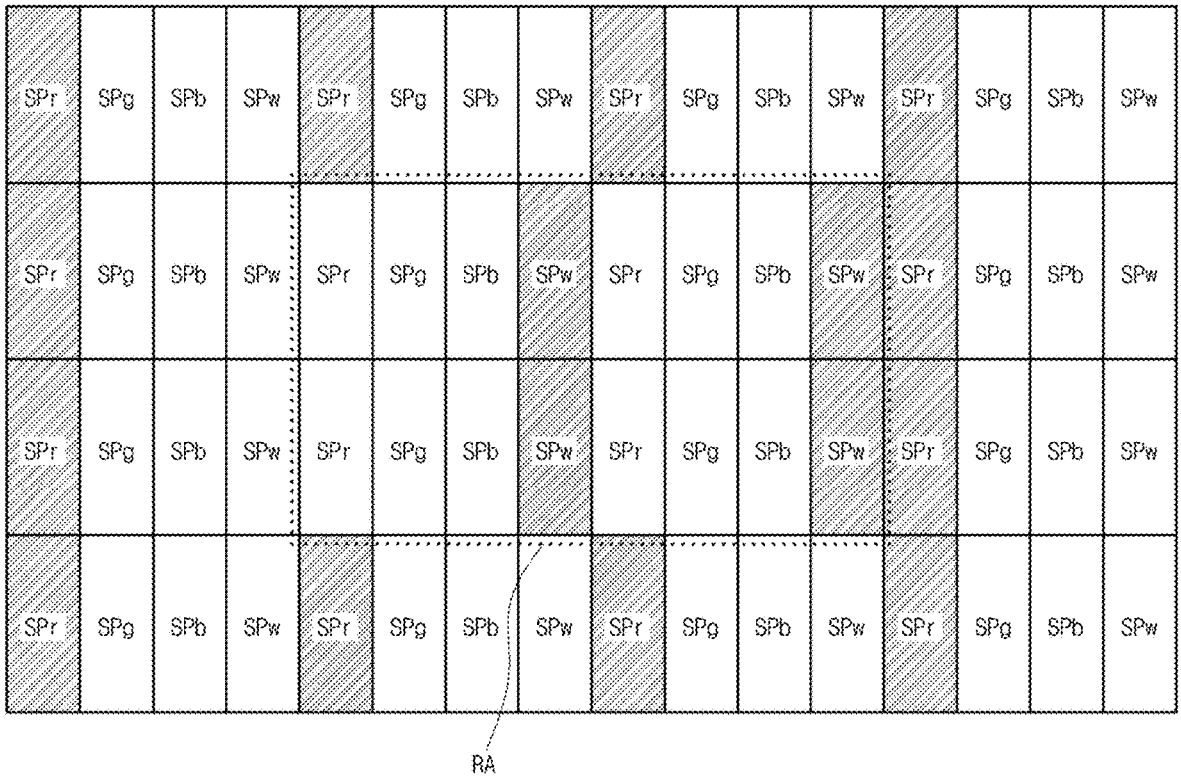

FIGS. 10A and 10B are views showing an emission state of a residual image area of a display device for first and second time periods, respectively, according to a second embodiment of the present disclosure.

In FIG. 10A, when the display device 110 (of FIG. 1) according to a second embodiment of the present disclosure displays a white for the first time period TP1, the four color image data RGBW of the first four color data RGBW1 having the red gray level data of 0 is displayed in the residual image area RA and the adjacent area.

The red subpixel SPr of the residual image area RA and the adjacent area does not emit a light and the green, blue and white subpixels SPg, SPb and SPw emit a light. As a result, a light efficiency of the pixel P is improved in the residual image area RA and the adjacent area.

In FIG. 10B, when the display device 110 according to a second embodiment of the present disclosure displays a white for the second time period TP2, the four color image data RGBW of the second four color data RGBW2 having the white gray level data of 0 is displayed in the residual image area RA, and the four color image data RGBW of the first four color data RGBW1 having the red gray level data of 0 is displayed in the adjacent area other than the residual image data RA.

The red, green and blue subpixels SPr, SPg and SPb of the residual image area RA emit a light and the white subpixel SPw of the residual image area RA does not emit a light. The red subpixel SPr of the adjacent area does not emit a light and the green, blue and white subpixels SPg, SPb and SPw of the adjacent area emit a light. As a result, in the residual image area RA, a stress concentrated on the white subpixel SPw is dispersed to the red, green and blue subpixels SPr, SPg and SPb and deterioration of the white subpixel SPw is minimized.

Figure 11:
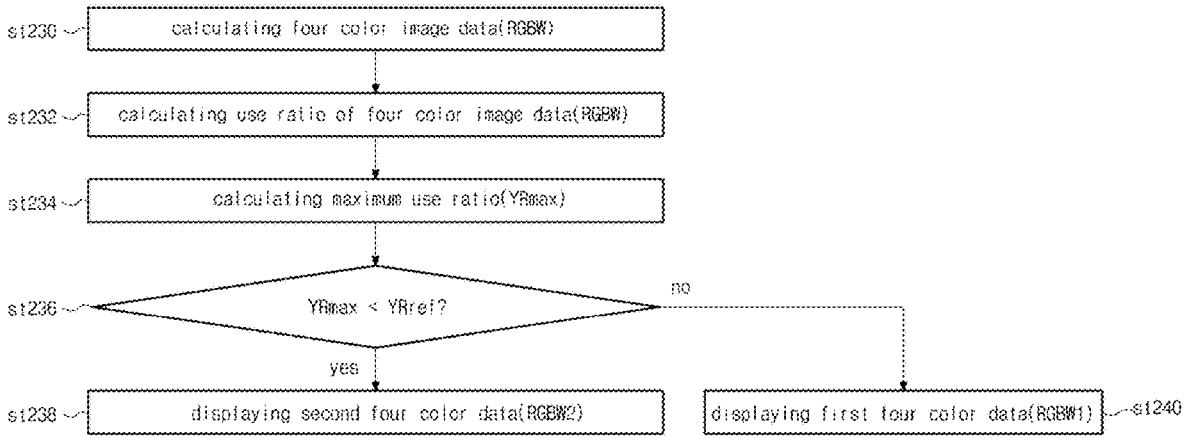
FIG. 11 is a flow chart showing a method of determining a time ratio of a display device according to a second embodiment of the present disclosure.

FIG. 11 is a flow chart showing a method of determining a time ratio of a display device according to a second embodiment of the present disclosure.

In FIG. 11, the timing controlling part 120 (of FIG. 1) of the display device 110 (of FIG. 1) according to a second embodiment of the present disclosure may update the time ratio β with a predetermined period by selecting one from the first and second four color data RGBW1 and RGBW2.

The timing controlling part 120 calculates the cumulative luminance averages Yra(R), Yra(G) and Yra(B) of the red, green and blue gray level data of the four color image data RGBW corresponding to an achromatic color (white) of the residual image area RA and calculates the cumulative luminance averages Yaa(R), Yaa(G) and Yaa(B) of the red, green and blue gray level data of the four color image data RGBW corresponding to a chromatic color of the adjacent area of the residual image area RA. (st230)

Next, the timing controlling part 120 calculates the red, green and blue use ratios YR(R), YR(G) and YR(B). (st232) The red, green and blue use ratios YR(R), YR(G) and YR(B) may be defined as a ratio of the cumulative luminance averages Yra(R), Yra(G) and Yra(B) of the four color image data RGBW of the residual image area RA to the cumulative luminance averages Yaa(R), Yaa(G) and Yaa(B) of the red, green and blue gray level data of the four color image data RGBW of the adjacent area. (YR(R)=Yra(R)/Yaa(R), YR(G)=Yra(G)/Yaa(G), YR(B)=Yra(B)/Yaa(B))

Next, the timing controlling part 120 calculates the maximum use ratio YRmax by selecting a maximum value from the red, green and blue use ratios YR(R), YR(G) and YR(B)(YRmax=MAX(YR(R), YR(G), YR(B)). (st234)

Next, the timing controlling part 120 compares the maximum use ratio YRmax with a predetermined reference use ratio YRref. (st236)

When the maximum use ratio YRmax is smaller than the reference use ratio YRref (YRmax<YRref), the white is displayed using the second four color data RGBW2 as the four color image data RGBW and the time ratio β increases to be updated. (st238)

When the maximum use ratio YRmax is not smaller than (equal to or greater than) the reference use ratio YRref (YRmax≥YRref), the white is displayed using the first four color data RGBW1 as the four color image data RGBW and the time ratio β decreases to be updated. (st240)

Although the first four color data RGBW1 is generated as the four color image data RGBW when the maximum use ratio YRmax and the reference use ratio YRref are equal to each other (YRmax=YRref) in the second embodiment, the second four color data RGBW2 may be generated as the four color image data RGBW when initial value of the luminance ratio α may be maintained without change when the maximum use ratio YRmax and the reference use ratio YRref are equal to each other (YRmax=YRref) in another embodiment.

For example, the timing controlling part 120 of the display device 110 according to a second embodiment of the present disclosure may update the time ratio β.

At the beginning of driving the display device 110, the timing controlling part 120 generates the four color data RGBW1 as the four color image data RGBW. When the reference use ratio YRref is 0.5, after 1000 hours from the beginning of the display device 110, the timing controlling part 120 may calculate the cumulative luminance averages Yra(R), Yra(G) and Yra(B) of the red, green and blue gray level data of the four color image data RGBW corresponding to the achromatic color (white) of the residual image area RA as about 0 nit, about 15 nit and about 5.5 nit, respectively, and may calculate the cumulative luminance averages Yaa(R), Yaa(G) and Yaa(B) of the red, green and blue gray level data of the four color image data RGBW corresponding to the chromatic color of the adjacent area as about 105 nit, about 350 nit and about 45 nit, respectively. (st230)

The timing controlling part 120 may calculate the red, green and blue use ratios YR(R), YR(G) and YR(B) as about 0.0(=0/105), about 0.04(=15/350) and about 0.12(=5.5/45), respectively. (st232) The red, green and blue use ratios YR(R), YR(G) and YR(B) are defined as ratios of the cumulative luminance averages Yra(R), Yra(G) and Yra(B) of the red, green and blue gray level data of the four color image data RGBW corresponding to the achromatic color (white) of the residual image area RA to the cumulative luminance averages Yaa(R), Yaa(G) and Yaa(B) of the red, green and blue gray level data of the four color image data RGBW corresponding to the chromatic color of the adjacent area.

The timing controlling part 120 may calculate the maximum use ratio YRmax of about 0.12 by selecting a maximum value from the red use ratio YR(R) of about 0.0, the green use ratio of about 0.04 and the blue use ratio of about 0.12. (st234)

The timing controlling part 120 compares the maximum use ratio YRmax of about 0.12 with the reference use ratio YRref of 0.5. (st236) Since the maximum use ratio YRmax is smaller than the reference use ratio YRref, the timing controlling part 120 may update and increase the time ratio β by generating the second four color data RGBW2 as the four color image data RGBW.

After 1430(=1000+430) hours from the beginning of the display device 110, the timing controlling part 120 may calculate the cumulative luminance averages Yra(R), Yra(G) and Yra(B) of the red, green and blue gray level data of the four color image data RGBW corresponding to the achromatic color (white) of the residual image area RA as about 52.1 nit, about 177.6 nit and about 21.7 nit, respectively, and may calculate the cumulative luminance averages Yaa(R), Yaa(G) and Yaa(B) of the red, green and blue gray level data of the four color image data RGBW corresponding to the chromatic color of the adjacent area as about 105 nit, about 350 nit and about 45 nit, respectively. (st230)

The timing controlling part 120 may calculate the red, green and blue use ratios YR(R), YR(G) and YR(B) as about 0.50(=52.1/105), about 0.51(=177.6/350) and about 0.48 (=21.7/45), respectively. (st232) The red, green and blue use ratios YR(R), YR(G) and YR(B) are defined as ratios of the cumulative luminance averages Yra(R), Yra(G) and Yra(B) of the red, green and blue gray level data of the four color image data RGBW corresponding to the achromatic color (white) of the residual image area RA to the cumulative luminance averages Yaa(R), Yaa(G) and Yaa(B) of the red, green and blue gray level data of the four color image data RGBW corresponding to the chromatic color of the adjacent area.

The timing controlling part 120 may calculate the maximum use ratio YRmax of about 0.51 by selecting a maximum value from the red use ratio YR(R) of about 0.50, the green use ratio of about 0.51 and the blue use ratio of about 0.48. (st234)

The timing controlling part 120 compares the maximum use ratio YRmax of about 0.51 with the reference use ratio YRref of 0.5. (st236) Since the maximum use ratio YRmax is greater than the reference use ratio YRref, the timing controlling part 120 may update and decrease the time ratio β by generating the first four color data RGBW1 as the four color image data RGBW.

FIG. 12 is a view showing a lifetime improvement rate of a display device according to a second embodiment of the present disclosure.

In FIG. 12, as the time ratio β increases, the lifetime of a white light emitting layer of the white subpixel SPw (of FIG. 1) of the display device 110 (of FIG. 1) increases.

Before area ratios of the red, green, blue and white subpixels SPr, SPg, SPb and SPw to the pixel P (of FIG. 1) of the display device 110 are adjusted, the lifetime of the light emitting layer of the white subpixel SPw is 100% when the time ratio β is 0, and the lifetime of the light emitting layer of the white subpixel SPw is 195% when the time ratio β is 0.5. As a result, the lifetime of the light emitting layer of the white subpixel SPw for the time ratio β of 0.5 increases by about 95% as compared with the lifetime of the light emitting layer of the white subpixel SPw for the time ratio β of 0.

After area ratios of the red, green, blue and white subpixels SPr, SPg, SPb and SPw to the pixel P of the display device 110 are adjusted, the lifetime of the light emitting layer of the white subpixel SPw is 100% when the time ratio β is 0, and the lifetime of the light emitting layer of the white subpixel SPw is 111% when the time ratio β is 0.5. As a result, the lifetime of the light emitting layer of the white subpixel SPw for the time ratio β of 0.5 increases by about 11% as compared with the lifetime of the light emitting layer of the white subpixel SPw for the time ratio β of 0.

In the display device 110 according to a second embodiment of the present disclosure, since the lifetime of the light emitting layer of the white subpixel SPw increases, the area ratio of the white subpixel SPw to the pixel P may decrease. As a result, although the lifetime improvement rate of the light emitting layer of the white subpixel SPw after adjusting the area ratio relatively decreases as compared with the lifetime improvement rate of the light emitting layer of the white subpixel SPw before adjusting the area ratio, the lifetime of the light emitting layer of the white subpixel SPw after adjusting the area ratio relatively increases as compared with the lifetime of the light emitting layer of the white subpixel SPw of the comparison example.

In the display device 110 according to a second embodiment of the present disclosure, since a white of the residual image area RA is displayed using the four color image data RGBW corresponding to an average value of the first four color data RGBW1 having the white gray data different from 0 (greater than 0) and the second four color data RGBW2 having the white gray data of 0 according to a time, deterioration of the light emitting layer of the white subpixel SPw is minimized such that the residual image is prevented and the lifetime increases.

Consequently, in the display device according to the present disclosure, since the white of the residual image area is displayed using the four color image data of a sum of the first four color data having the gray level data corresponding to the white color and the second four color data not having the gray level data corresponding to the white color, deterioration of the white subpixel is minimized to prevent the residual image and the lifetime is improved.

Further, since the white of the residual image area is displayed using the first four color data having the gray level data corresponding to the white color and the second four color data not having the gray level data corresponding to the white color alternately, deterioration of the white subpixel is minimized to prevent the residual image and the lifetime is improved.

It will be apparent to those skilled in the art that various modifications and variation can be made in the display device and the method of driving the same of the present disclosure without departing from the spirit or scope of the disclosure. Thus, it is intended that the present disclosure cover the modifications and variations of this disclosure provided they come within the scope of the appended claims and their equivalents.

What is claimed is:

1. A display device, comprising:

a timing controlling part for generating a three color image data for a first pixel, a data control signal and a gate control signal using an image signal and a plurality of timing signals, generating a first four color data having a white gray level data greater than 0 using the three color image data for the first pixel and a second four color data having the white gray level data of 0 using the three color image data for the first pixel, and generating a four color image data using a combination of the first and second four color data;

a data driving part for generating a data signal using the four color image data and the data control signal;

a gate driving part for generating a gate signal using the gate control signal; and a display panel including a second pixel having red, green, blue and white subpixels and displaying an image using the data signal and the gate signal, wherein each of the first and second four color data includes red, green, blue and white gray level data, wherein for each of the first and second four color data: at least one of the red, green and blue gray level data is 0, and at least one of the red, green and blue gray level data is greater than 0.

2. The display device of claim 1, wherein the display panel steadily displays a white in a residual image area using the data signal and the gate signal corresponding to the four color image data.

3. The display device of claim 2, wherein the residual image area corresponds to a top 10% of a histogram of a cumulative luminance average of the pixel.

4. The display device of claim 1, wherein the timing controlling part is configured to generate the four color image data by adding first and second contributing components, and wherein the first contributing component is a product of the first four color data and a value obtained by subtracting a luminance ratio from 1, and the second contributing component is a product of the second four color data and the luminance ratio.

5. The display device of claim 4, wherein the luminance ratio is updated according to a change of cumulative luminance averages of the red, green and blue gray level data of the four color image data of the residual image area and the red, green and blue gray level data of the four color image data of an adjacent area other than the residual image area.

6. The display device of claim 1, wherein the timing controlling part is configured to generate the first four color data as the four color image data for a first time period, and generate the second four color data as the four color image data for a second time period alternating with the first time period.

7. The display device of claim 6, wherein the a time ratio of the first and second time periods is updated according to a change of cumulative luminance averages of the red, green and blue gray level data of the four color image data of the residual image area and the red, green and blue data of the four color image data of an adjacent area other than the residual image area.

8. A method of driving a display device, comprising:

generating a three color image data for a first pixel, a data control signal and a gate control signal using an image signal and a plurality of timing signals, generating a first four color data having a white gray level data greater than 0 using the three color image data for the first pixel and a second four color data having the white gray level data of 0 using the three color image data for the first pixel, and generating a four color image data using a combination of the first and second four color data;

generating a data signal using the four color image data and the data control signal;

generating a gate signal using the gate control signal; and displaying an image using the data signal and the gate signal in a display panel including a second pixel having red, green, blue and white subpixels, wherein each of the first and second four color data includes red, green, blue and white gray level data, wherein for each of the first and second four color data: at least one of the red, green and blue gray level data is 0, and at least one of the red, green and blue gray level data is greater than 0.

9. The method claim 8, wherein generating the four color image data comprises:

calculating a first contributing component by multiplying the first four color data and a value obtained by subtracting a luminance ratio from 1 and calculating a second contributing component by multiplying the second four color data and the luminance ratio; and generating a sum of the first and second contributing components as the four color image data.

10. The method of claim 8, wherein generating the four color image data comprises:

generating the first four color data as the four color image data for a first time period, and generating the second four color data as the four color image data for a second time period alternating with the first time period.

11. The method of claim 8, wherein the display panel steadily displays a white in a residual image area using the data signal and the gate signal corresponding to the four color image data.

12. The method of claim 11, wherein the residual image area corresponds to a top 10% of a histogram of a cumulative luminance average of the pixel.

13. The method of claim 9, wherein the luminance ratio is updated according to a change of cumulative luminance averages of the red, green and blue gray level data of the four color image data of a residual image area and the red, green and blue gray level data of the four color image data of an adjacent area other than the residual image area.

14. The method of claim 10, wherein the a time ratio of the first and second time periods is updated according to a change of cumulative luminance averages of the red, green and blue gray level data of the four color image data of a residual image area and the red, green and blue data of the four color image data of an adjacent area other than the residual image area.

* * * * *